United States Patent [19]

Takigawa et al.

[11] Patent Number: 4,751,987

[45] Date of Patent: Jun. 21, 1988

[54] SLIDE-TYPE EXHAUST BRAKING SYSTEM

[75] Inventors: Kazunori Takigawa, Sanmaibashi; Ryoichi Suzuki, Mishima, both of Japan

[73] Assignee: Usui Kokusai Sangyo Kabushiki Kaisha, Nagasawa, Japan

[21] Appl. No.: 106,176

[22] Filed: Sep. 30, 1987

[51] Int. Cl.[4] ..... F02D 9/06

[52] U.S. Cl. ..... 188/273

[58] Field of Search ..... 123/323; 188/154, 273

[56] References Cited

U.S. PATENT DOCUMENTS 4,685,544 8/1987 Takigawa et al. ..... 188/273

*Primary Examiner*—Duane A. Reger

*Attorney, Agent, or Firm*—Anthony J. Casella; Gerald E. Hespos

[57] ABSTRACT

There is disclosed a slide-type exhaust braking system for applying a braking function to a vehicle by blockading a passageway for an exhaust gas. This system includes an exhaust pressure adjusting hole passageway disposed at a bottom wall portion of a reciprocation passageway of a valve member in a body housing so that the hole passageway leads to a rear passageway. The system further includes an auxiliary valve member disposed at the hole peripheral portion, this auxiliary valve member being biased by springs. The exhaust pressure adjusting hole passageway is closed by pressing the auxiliary valve member with the piston rod and is opened with an upward movement of the piston rod. Impulsive forces acting on the auxiliary valve member are absorbed by shock-absorbing means provided at the tip of the piston rod or by virtue of a double valve structure.

9 Claims, 2 Drawing Sheets

SLIDE-TYPE EXHAUST BRAKING SYSTEM

BACKGROUND OF THE INVENTION

The present invention relates to a slide-type exhaust braking system intended to apply a braking function to a vehicle by blockading a passageway for an exhaust gas on the occasion of a sharp downward slope, this braking system being connectively interposed in an exhaust pipe generally in large-sized vehicles such as a track, a bus or the like.

2. Description of the Prior Art

FIG. 4 is a partially cut-away view illustrating the principal portion in section of a prior art exhaust braking system of this type. The system is, as shown in the Figure, arranged such that: a body housing (21) of the exhaust braking system is formed with an internal exhaust passageway (22) and a reciprocation passageway (23) appropriated to a tabular valve member (24), this reciprocation passageway (23) communicating with the exhaust passageway (22) so as to extend in the direction substantially orthogonal to this passageway (22); in the reciprocation passageway (24) the valve member (24) includes an exhaust pressure adjusting hole (25) consisting of a slot which is so formed in the bottom portion in front thereof as to lead to the rear passageway, the valve member (24) being loosely engaged with a portion vicinal to the tip of a piston rod (26) projecting on the side of an actuator device (not illustrated) with the help of an upper retaining groove wall (24') provided in the front thereof; a middle pressure receiving member is pressed by the tip of the piston rod (26); an inducement wall member (27) is mounted on the piston rod (26) which is positioned between the retaining groove wall (24') and the pressure receiving wall (24'') to engage with the retaining groove wall (24') when the exhaust passageway is opened by the valve member (24); an auxiliary valve member (28) mounted on the inducement wall member (27) slides on the surface of the valve member (24) upon a press against the middle pressure receiving wall (24'') when the exhaust passageway (22) is closed by the valve member (24), thereby closing the exhaust pressure adjusting hole (25); when the exhaust passageway is opened, the auxiliary valve member (28) slides to open the exhaust pressure adjusting hole (25) following the engagement with the retaining groove wall (24') with the movement of the piston rod (26) prior to the step of opening the exhaust passageway, with the result that the exhaust gas stagnant in the front portion partially escapes through the exhaust pressure adjusting hole (25) toward the rear passageway; and the exhaust pressure appiled to the valve member (24) is thus decreased.

There arise, however, some problems inherent in the conventional exhaust braking system. Namely, deterioration in mechanical strength is caused in the valve member (24) because of a structure of the exhaust pressure adjusting hole (25) consisting of the slot penetrating the bottom in front of the valve member (24). Friction damages and abrasion are created on the friction surface between the auxiliary valve member (28) and the surface in the vicinity of the exhaust pressure adJusting hole (25) of the valve member on account of opening/closing operations of the valve member (24) which are repeated with high frequency during the operation of the system. A decline in close engagement between the two members continues to be produced for a long stretch of time, whereby the braking function is forced to decrease.

SUMMARY OF THE INVENTION

It is a general object of the present invention which obviates the above-described problems inherent in the prior art in a highly effective manner to provide a slide-type exhaust braking system.

It is a more specific object of the invention to provide a slide-type exhaust braking system arranged such that: an exhaust pressure adjusting hole passageway is formed in a bottom wall portion of a reciprocation passageway for a valve member in a body housing so that the exhaust pressure adjusting hole passageway leads from the bottom wall portion to a passageway behind a passageway-closing-position of the valve member in an exhaust passageway; an auxiliary valve member disposed at a hole peripheral portion formed in the bottom wall portion so that the auxiliary valve member is baised by springs in such a direction as to open the hole passageway; alternatively, the whole valve structure is biased in such a direction as to open the hole passageway by virtue of a double valve structure in which a valve body is biased upwards by the springs secured to a stepped-wall portion in close proximity to the hole peripheral portion and an auxiliary valve member connectively attached to the valve member by a separately provided spring are disposed at the hole peripheral portion of the bottom wall portion of the exhaust pressure adjusting hole passageway; and communication holes which pass through the valve member and communicate with an upper portion of the auxiliary valve member positioned downwards are formed. In this constitution, a sufficient mechanical strength with respect to the valve member is obtained by virtue of the structure and position of the exhaust pressure adjusting hole passageway, and of an axially opening/closing mechanism of the auxiliary valve member, or this auxiliary valve member and the valve body with the aid of the press-operation and repulsive forces of springs. The above-described arrangement eliminates a probability for damages and abrasion to be produced in connection with the auxiliary valve member in the vicinity of hole peripheral portion of the exhaust pressure adjusting hole passageway. Close engagement with the auxiliary valve member is favourably maintained for a long time to exihibit a reliable braking function. When the exhaust passageway is closed, the piston rod presses directly the auxiliary valve member or the auxiliary valve member connected to the valve body by making most of a shock-absorbing function. As a result, it is possible to prevent the abrasion and damages in an early stage and to reduce an amount of occurrence of an impulsive sound by absorbing the impulsive forces.

It is another object of the invention to provide, in an exhaust braking system in which: an internal exhaust passageway is provided with connection walls each having a connection to an exhaust pipe, these walls being bilaterally provided at both side ends thereof; the body housing of the exhaust braking system is formed with the reiprocation passageway for the tabular valve member so as to communicate with the foregoing exhaust passageway; the valve member is incorporated in the reciprocation passageway in the direction substantially orthogonal to the exhaust passageway; the valve member is loosely engaged with the portion vicinal to the tip of the piston rod protrusively penetrating a bottom partition wall provided on the side of the actuator connectively provided at the end of the reciprocation passageway in the body housing; and the valve member performs the opening/closing operations with respect to the exhaust passageway by vertically reciprocating the piston rod, and further in a slide-type exhaust braking system or in an exhaust braking system including the exhaust pressure adjusting hole passageway in which: the exhaust pressure adjusting hole passageway leading from the bottom wall portion to a passageway behind a passageway-closing-position of the valve member in the exhaust passageway is formed in the bottom wall portion of the reciprocation passageway for the valve member which communicates with the exhaust passageway in the body housing., the auxiliary valve member biased by the springs in such a direction as to open the hole passageway is disposed at the hole peripheral portion of the bottom wall portion of the exhaust pressure adjusting hole passageway; followed by a step of clsoing the exhaust passageway, the tip of the piston presses the auxiliary valve member to close the exhaust pressure adjusting hole passageway; and when opening the exhaust passageway, the exhaust pressure adjusting hole passageway is opened by dint of the repulsive forces of the springs upon an upward movement of the piston for releasing the pressed-state prior to the operation of opening the exhaust passageway, the improvement characterized in that: the whole valve structure is biased in such a direction as to open the hole passageway owing to a double valve structure wherein the auxiliary valve member connectively attached to the valve body by means of separately provided springs is disposed at the hole peripheral portion of the bottom wall portion of the exhaust pressure adjusting hole passageway, the valve body being biased upwards by the springs secured to a stepped wall portion in the vicinity of the peripheral portion; communication holes are so formed as to pass through the valve body and lead to the upper portion of the auxiliary valve member positioned downwards; followed by a step of closing the exhaust passageway, the tip of the piston presses the valve body, thereby closing the hole perihpheral portion formed in the top of the stepped wall portion; the exhaust pressure adJusting hole passageway is closed by the auxiliary valve member; when opening the exhaust passageway, the exhaust pressure adjusting hole passageway is opened by the auxiliary valve member, following the step of opening the hole peripheral portion by means of the valve body, by dint of the spring's repulsive forces with the upward movement of the piston for releasing the pressed-state prior to the operation of opening the exhaust passageway; and the piston rod is invested with a shock-absorbing function applied to the auxiliary valve member when effecting the press-operation by providing a spring at the tip of the piston rod.

BRIEF DESCRIPTION OF THE DRAWINGS

These and other objects, features and advantages of the invention will become more apparent on reading the following detailed description when considered in connection with the accompanying drawings, in which.

DETAILED DESCRIPTION OF THE INVENTION

Figure 1:
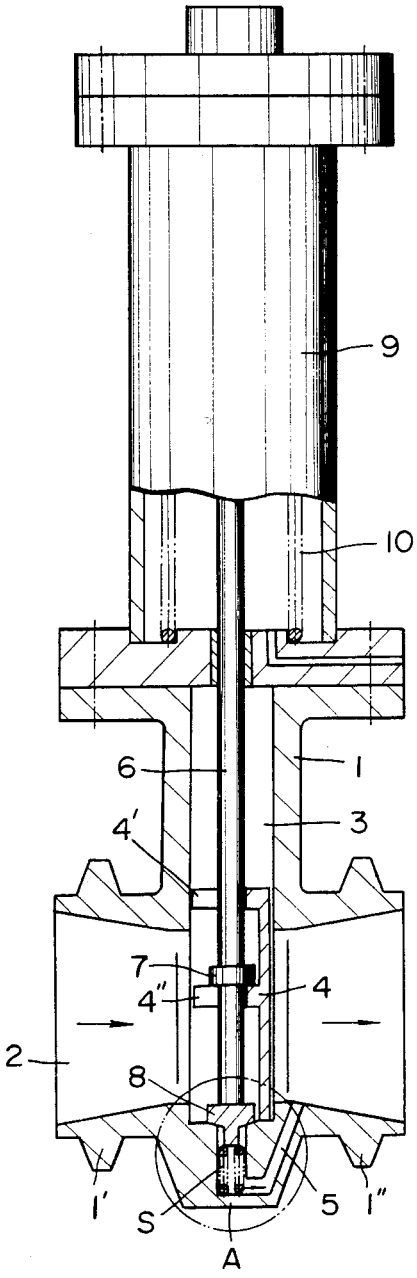
FIG. 1 is a partially cut-away view in section of a slide-type exhaust braking system, illustrating one embodiment of the present invention.

In the Figures an exhaust braking system includes a body housing generally designated (1). This body housing (1) has a reciprocation passageway (3) for a tabular valve member (4) which is formed to communicate with an internal exhaust passageway (2) in the direction orthogonal to this exhaust passageway (2). The body housing (1) further includes connection walls (1') and (1'') each having a connection to an exhaust pipe (not illustrated), these connection walls (1') and (1'') being bilaterally provided on both sides thereof. The valve member (4) is incorporated in the reciprocation passageway (3). The valve member (4) is loosely engaged with a portion vicinal to the tip of a piston rod (6) protrusively penetrating a bottom partition wall of an actuator device (9) connectively provided at the end of the reciprocation passageway (3) in the body housing (1). Opening/closing operations of the valve member (4) in the exhaust passageway (2) are carried out by vertically reciprocating the piston rod (6).

Means for attaching the valve member (4) to the piston rod (6) is arranged in such a manner that the piston rod (6) passes through upper and middle retaining groove walls (4') and (4'') provided in front of the valve member (4) so as to be loosely engaged, and the valve member (4) engages with an inducement wall (7) provided on the piston rod(6) in a position between the retaining groove walls. The numeral (5) denotes an exhaust pressure adjusting hole passageway which is formed in a bottom wall portion of the reciprocation passageway communicating with the exhaust passageway (2) in the body housing (1), this exhaust pressure adjusting hole passageway leading from the bottom wall portion to a passageway behind a passageway closing-position of the valve member (4) in the exhaust passageway (2). An auxiliary valve member generally indicated at (8) is biased by means of springs (S) (see FIG. 1) in such a direction as to open the hole passageway, this auxiliary valve member (8) being disposed at the hole peripheral portion formed in the bottom wall portion of the exhaust pressure adjusting hole passageway (5). When the exhaust passageway (2) is closed by the valve member (4), the tip of the piston rod (6) presses the auxiliary valve member (8) to close the exhaust pressure adjusting hole passageway (5) following the above-mentioned operation of closing the exhaust passageway (2). On the occasion of opening the exhaust passageway, the exhaust pressure adjusting hole passageway (5) is opened by dint of the repulsive forces of the springs (S) with an upward movement of the piston rod (6) for releasing a pressed-state prior to the above-mentioned passageway-opening-operation. In consequence, an exhaust gas stagnant in the front portion of the valve member (4) is made to partially escape through the exhaust pressure adjusting hole passageway toward the rear passagesway, thus reducing an exhaust pressure applied to the valve member (4). Hence, the initial slide-motion of the valve member is smoothly performed. The numeral (10) represents a coil spring member for upwardly biasing a piston (not illustrated) incorporated in the actuator device (9).

Figure 2:
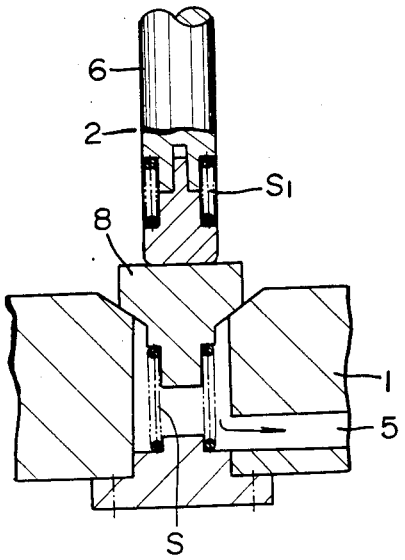
FIG. 2 is a partially enlarged view in section of the principal portion of another embodiment of the present invention.
Figure 4:
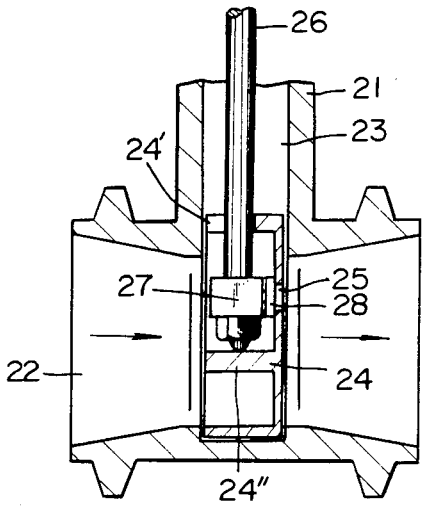
FIG. 4 is a partially cut-away view in section of the principal portion of a prior art system.
Figure 3:
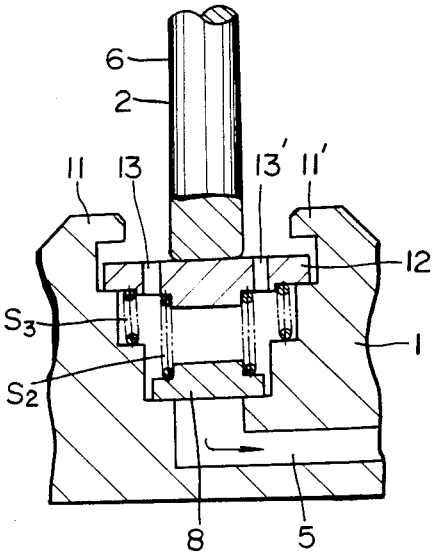
PRIOR ART Fig. 3
FIG. 3 is a view similar to FIG. 2, showing still another embodiment of the present invention.

The symbol (S1) in FIG. 2 designates a pair of springs secured to the tip of the piston rod (6), these springs being invested with a shock-absorbing function employed when pressing the auxiliary valve member (8). The whole valve structure is biased in such a direction as to open the hole passageway owing to a double valve structure wherein the auxiliary valve member is, as illustrated in FIG. 3, disposed at the hole peripheral portion of the bottom wall portion of the exhaust pressure adjusting hole passageway (5) in a state where separately provided springs (S2) span from the auxiliary valve member (8) to a valve body (12) biased upwards by springs (S3) secured to a stepped-wall portion in the vicinity of the hole pheripheral portion. Communication holes (13) and (13') are formed to pass through the valve body (12) and lead to the upper portion of the auxiliary valve member (8) positioned downwards, whereby the auxiliary valve member (8) is held in a given state at the hole peripheral portion of the exhaust pressure adjusting hole passageway (5). When pressing the auxiliary valve member (8) through the valve body (12), the shock-absorbing function works. When the exhaust passageway (2) is closed by the valve member (4), the tip of the piston rod (6) presses the valve body (12) following the above-described operation of closing the exhaust passageway, thereby closing the hole peripheral portion provided at the top of the stepped-wall portion. Simultaneously, the exhaust pressure adjusting hole passageway (5) is closed by the auxiliary valve member (8). Then, the auxiliary valve member (8) is pressed against the hole peripheral portion of the exhaust pressure adjusting hole passageway (5) by dint of the exhaust pressure coming from the communication holes (13) and (13'). At the time of opening the exhaust passageway, the auxiliary valve member (8) serves to open the exhaust pressure adjusting hole passageway (5) with the help of the springs (S2), following the step of opening opens the exhaust pressure adjusting hole passageway (5) by use of the valve body (12), by dint of the repulsive forces of the springs (S3) with the upward movement of the piston rod (6) for releasing the pressed-state before performing the above-mentioned operation of opening the exhaust passageway. As a result, part of the exhaust gas stagnating in the front portion of the valve member (4) escapes via the exhaust pressure adjusting hole passageway toward the rear passageway, thus reducing the exhaust pressure applied to the valve member (4). Retaining walls (11) and (11') are formed in close proximity to the top of the stepped wall portion, these retaining walls being designed for the valve body (12) which moves within the hole peripheral portion in connection with the step wherein the foregoing auxiliary valve member (8) opens the hole passageway (5).

It is to be noted that an arrowhead depicted with a solid line indicates the direction of a flow of the exhaust gas in the exhaust passageway (2) and in the exhaust pressure adjusting hole passageway (5).

According to the present invention having the above-described constitution, where the valve member (4) closes the exhaust passageway, the piston rod (6) moves downwards immediately when the gas having a high pressure is supplied from the outside to the actuator device (9). Then the inducement wall (7) mounted on the piston rod is engaged with the retaining groove wall (4'') to slide the valve member (4), thereby closing the exhaust passageway (2). Followed by this closing operation, the tip of the piston rod (6) presses directly the auxiliary valve member (8), or indirectly the auxiliary valve member (8) (FIG. 3) connected to the valve body (12) in order to close the exhaust pressure adjusting hole passageway (5). The braking function thus works. Where the exhaust passageway is opened, the press against the auxiliary valve member (8) is released by moving the piston rod (6) upwards prior to the step of opening the exhaust passageway, thereby opening the exhaust pressure adjusting hole passageway. In consequence of this, the exhaust gas stagnant in the front portion is allowed to partially escape toward the rear passageway. It follows that the exhaust pressure acting on the valve member (4) when opening the passageway is decreased in this way.

As is obvious from the description given above, the slide-type exhaust braking system according to the present invention is arranged as below. The exhaust pressure adjusting hole passageway (5) is formed in the bottom wall portion of the reciprocation passageway of the valve member (4) in the body housing (1) so that the exhaust pressure adjusting hole passageway (5) leads from the bottom wall portion to the passageway behind the passageway-closing-position of the valve member (4) in the exhaust passageway (2). The auxiliary valve member (8) is disposed at the hole peripheral portion formed in the bottom wall portion of the exhaust pressure adjusting hole passageway (5), the auxiliary valve member (8) being biased in such a direction as to open the hole passageway by means of the springs (S) or the springs (S2) and (S3). In this construction, the valve member (4) itself obtains a sufficient mechanical strength by virtue of the position and the structure of the exhaust pressure adjusting hole passageway (5). The tip of the piston rod (6) presses directly or indirectly the auxiliary valve member (8) in the axial direction. The exhaust pressure adjusting hole passageway (5) is opened and closed by the repulsive forces of the springs after releasing the pressed-state. With this arrangement, it is possible to eliminate a probability in which damages and abrasion in connection with the auxiliary valve member (8) will be created in the vicinity of the hole peripheral portion of the exhaust pressure adjusting hole passageway. Close engagement with the auxiliary valve member continues to be held for a long stretch of time, thereby exhibiting the reliable braking function. Impulsive forces acting on the auxiliary valve member (8) when closing the passageway are absorbed by virtue of the shock-absorbing function imparted to the tip of the piston rod (6) or based on the double valve structure. It is therefore feasible to prevent the abrasion and damages in an early stage and to considerably reduce a magnitude of impulsive sound. The highly useful slide type exhaust braking system is thus obtained.

As many apparently widely different embodiments of this invention may be made without departing from the spirit and scope thereof, it is to be understood that the invention is not limited to the specific embodiments thereof except as defined as the appended claims.

What is claimed is:

1. In an exhaust braking system in which: an internal exhaust passagesway is provided with connection walls each having a connection to an exhaust pipe, said connection walls being bilaterally provided at both side ends thereof; a body housing of said exhaust braking system is formed with a reciprocation passageway for a tabular valve member so as to communicate with said exhaust passageway; said valve member is incorporated in said reciprocation passageway in the direction substantially orthogonal to said exhaust passageway; said valve member is loosely engaged with a portion vicinal to the tip of a piston rod protrusively penetrating a bottom partition wall provided on the side of an actuator connectively provided at the end of said recirocation passageway in said body housing; and said valve member performs opening/closing operations with respect to said exhaust passageway by vertically reciprocating said piston rod, a slide-type exhaust braking system characterized by comprising:

an exhaust pressure adjusting hole passageway provided at a bottom wall portion of said reciprocation passageway communicating with said exhaust passageway in said body housing, said exhaust pressure adjusting hole passageway leading from said bottom wall portion to a passageway behind a passageway-closing-position in said exhaust passageway; and an auxiliary valve member disposed at a hole peripheral portion of said bottom wall portion of said exhaust pressure adjusting hole passageway so that said auxiliary valve member is biased in such a direction as to open said hole passageway, wherein when closing said exhaust passageway, the tip of said piston rod presses said auxiliary valve member following the operation of closing said exhaust passageway in order to close said exhaust pressure adjusting hole passageway, and wherein when opening said exhaust passageway, said exhaust pressure adjusting hole passageway is opened with an upward movement of said piston rod for releasing a pressed-state prior to the operation of opening said exhaust passageway.

2. A slide-type exhaust braking systm as set forth in claim 1, wherein means for biasing said auxiliary valve member consists of springs.

3. A slide-type exhaust braking system as set forth in claim 1, wherein shock-abdosrbing means relative to said auxuliary valve member is provided at the tip of said piston rod.

4. A slide-type exhaust braking system as set forth in claim 3, wherein said shock absorbing means is composed of a spring.

5. In an exhaust braking system in which: an internal exhaust passageway is provided with connection walls each having a connection to an exhaust pipe, said connection walls being bilaterally provided at both side ends thereof; a body housing of said exhaust braking system is formed with a reciprocation passageway for a tabular valve member so as to communicate with said exhaust passageway; said valve member is incorporated in said reciprocation passageway in the direction substantially orthogonal to said exhaust passageway; said valve member is loosely engaged with a portion vicinal to the tip of a piston rod protrusively penetrating a bottom partition wall provided on the side of an actuator connectively provided at the end of said reciprocation passageway in said body housing; and said valve member performs opening/closing operations with respect to said exhaust passageway by vertically reciprocating said piston rod, a slide-type exhaust braking system characterized by comprising:

an exhaust pressure adjusting hole passageway provided at a bottom wall portion of said reciprocation passageway communcating with said exhaust passageway in said body housing, said exhaust adjusting hole passageway leading from said bottom wall portion to a passageway behind a passageway-closing-position in said exhaust passageway; a valve member disposed at a hole peripheral portion formed in said bottom wall portion of said exhaust pressure adjusting hole passageway so that said valve member formed with a communication hole is biased upwards; and an auxiliary valve member disposed in parallel with said valve member through springs, wherein when closing said exhaust passageway, the tip of said piston rod presses a valve body following the operation of closing said exhaust passageway in order to open said hole peripheral portion, wherein said exhaust pressure adjusting hole passageway is closed by said axuliary valve member, and wherein when opening said exhaust passageway, said exhaust pressure adjusting hole passageway is opened by said auxiliary valve member immediately after said valve body has opened said hole peripheral portion with an upward movement of said piston rod for releasing a pressed state prior to the step of opening said exhaust passageway.

6. A slide-type exhaust braking system as set forth in claim 5, wherein said valve body sits on a stepped-wall portion of said hole peripheral portion.

7. A slide-type exhaust braking system as set forth in claim 5, wherein means for biasing said valve body upwards involves the use of springs.

8. A slide-type exhaust braking system as set forth in claim 7, wherein said valve body biased by said springs impinges upon retaining walls provided at the top of said hole peripheral portion.

9. A slide-type exhaust braking system as set forth in claim 5, wherein said hole pheripheral portion is constituted by three stepped-wall portions.

* * * * *